United States Patent [19]

Davies et al.

[11] 4,051,054

[45] Sept. 27, 1977

[54] DETERGENT COMPOSITIONS

[75] Inventors: Charles Bloor Davies, Wallasey; James Francis Davies, Wirral, both of England

[73] Assignee: Lever Brothers Company, New York, N.Y.

[21] Appl. No.: 685,597

[22] Filed: May 12, 1976

Related U.S. Application Data

[63] Continuation of Ser. No. 510,664, Sept. 30, 1974, abandoned.

[30] Foreign Application Priority Data

Oct. 1, 1973 United Kingdom ..... 45688/73

[51] Int. Cl.[2] ..... C11D 1/66; C11D 3/10

[52] U.S. Cl. ..... 252/89 R; 252/109; 252/131; 252/160; 252/259.5; 252/383; 252/DIG. 15

[58] Field of Search ..... 252/89, 131, 160, 259.5, 252/109, DIG. 1, DIG. 15, 383

[56] References Cited

U.S. PATENT DOCUMENTS

| | | | |
|---|---|---|---|
| 2,797,196 | 6/1957 | Dunn et al. | 252/8.5 M |
| 3,843,563 | 10/1974 | Davies et al. | 252/139 |
| 3,865,754 | 2/1975 | Norris et al. | 252/140 |

*Primary Examiner*—Mayer Weinblatt

*Attorney, Agent, or Firm*—Kenneth F. Dusyn; James J. Farrell; Melvin H. Kurtz

[57] ABSTRACT

A detergent additive is prepared by adsorbing a non-ionic detergent active compound onto finely divided calcium carbonate, to facilitate the processing of detergent compositions. The additive is preferably employed in detergent compositions with alkali metal carbonate detergency builders, where the calcium carbonate tends to improve detergency and decrease deposits on washed fabrics.

12 Claims, No Drawings

DETERGENT COMPOSITIONS

This is a continuation of application Ser. No. 510,664, filed Sept. 30, 1974, now abandoned.

The present invention concerns detergent compositions, and particularly detergent compositions which contain nonionic detergent compounds.

Nonionic detergent compounds are very well known for use in fabric washing detergent compositions, but their use can cause problems, especially in the production of detergent powders. Specifically, during conventional slurry making processes, the nonionic ingredients sometimes tend to separate out which can cause problems during the subsequent spray drying, particularly by presenting a fire hazard or by the formation of so-called blue smoke from spray drying towers. In addition, particularly in the case of liquid or semi-liquid nonionic detergent compounds, there can be "bleeding" of the nonionic compounds from the resultant detergent powders during storage, and the powders can have poor flow properties which detract from their consumer acceptance.

It has been proposed to adsorb nonionic detergent compounds onto finely divided materials such as silica, and then to incorporate the resultant powder into detergent compositions after spray drying. However, the adsorbent materials which have been most effective for this purpose have generally had little useful function in the detergent compositions, that is apart from merely acting as an adsorbent for the nonionic detergent compounds. On the other hand, certain materials which do not have a useful function in detergent compositions, for example certain condensed phosphates which function as detergency builders and which have been proposed as adsorbents for nonionic compounds, are generally relatively inefficient in the latter respect.

According to the present invention finely divided calcium carbonate is used as an adsorbent for nonionic detergent compounds. The invention provides a solid additive for a detergent composition comprising a nonionic detergent compound adsorbed onto finely divided calcium carbonate, and also a detergent composition incorporating such an additive. The finely divided calcium carbonate has been found to be a very efficient adsorbent of the nonionic detergent compounds, and yet on dissolution in water the nonionic compounds are readily desorbed so as to function effectively in fabric washing processes. Moreover, finely divided calcium carbonate has a very useful function in certain detergent compositions.

In the specification of our copending U.S. Pat. Ser. No. 386,827 we have described detergent compositions which are based on an alkali metal carbonate detergency builder together with finely divided calcium carbonate and a detergent compound or compounds. Alkali metal carbonates, particularly sodium carbonate, are of course well known detergency builders which function by removing the calcium from hard water in the form of precipitated calcium carbonate. But such calcium carbonate tends to accumulate on washing machine surfaces and on washed fabrics, and this can lead to fabric harshness. However, the compositions with the added finely divided calcium carbonate tend to form less inorganic deposits on washed fabrics, apparently because the precipitated calcium carbonate is deposited on the added calcium carbonate instead of on the fabrics or washing machines. Moreover, by encouraging the calcium hardness in the wash water to be removed from solution in this way, the detergencies of the compositions are improved. The added calcium carbonate also appears to act as a scavenger for calcium carbonate precipitation inhibitors which were found to be commonly present in wash liquors; this scavenging facilitates the calcium carbonate precipitation process and further increases the effect of the added calcium carbonate.

Thus, the finely divided calcium carbonate which is used as an adsorbent for nonionic detergent compounds according to the present invention finds particular application in the detergent compositions as described in our aforementioned patent application. If desired, however, the additive of the present invention could be used in other detergent compositions where the finely divided calcium carbonate does not have the additional function which is achieved when an alkali metal carbonate is the builder. In this event other conventional detergency builders are usually present in the detergent compositions.

The nonionic detergent compound used in the present invention may be any of the conventional materials of this type which are very well known and fully described in the literature, for example in "Surface Active Agents and Detergents" Volumes I and II by Schwartz, Perry & Berch and in "Nonionic Surfactants" by M. J. Schick. The nonionic detergent compounds of most commercial interest and which are most readily available include in particular ethoxylated synthetic or natural fatty alcohols, preferably linear primary or secondary monohydric alcohols with $C_{10}$–$C_{18}$, preferably $C_{10}$–$C_{15}$, alkyl groups and about 5–15, preferably 7–12, ethylene oxide (EO) units per molecule. Alternatively, ethoxylated alkyl phenols with $C_8$–$C_{16}$ alkyl groups, preferably $C_8$–$C_9$ alkyl groups and from about 4–12 EO units per molecule, or ethoxylated fatty acid amides may be used. Other nonionic detergent compounds which can be used for the purposes of the present invention will be readily apparent to those skilled in the art. It will be appreciated that the nonionic compounds which are used to the greatest benefit are liquid compounds which are more difficult to incorporate into detergent compositions otherwise, though pasty or solid nonionic detergent compounds may also be used. In the latter case, adsorption of the nonionic compound onto the calcium carbonate may be facilitated by the use of elevated temperatures.

The calcium carbonate should be finely divided, and should preferably have surface area of at least about 5 square meters per gram ($m^2/g$), generally at least about 10 $m^2/g$, and preferably at least about 20 $m^2/g$. The particularly preferred calcium carbonate has a surface area of about 30 to about 100 $m^2/g$, especially about 50 to about 85 $m^2/g$. Calcium carbonate with surface areas in excess of about 100 $m^2/g$ may be used if such materials are economically available, but it appears to be unlikely that any higher surface areas will be achievable commerically and this may in any case be undesirable for other reasons; for example especially small particles, i.e. with very high surface areas, may have a tendency to be adsorbed onto fabrics during washing process, and there may be dust problems during processing.

Surface areas of the calcium carbonate are determined by the standard Brunauer, Emmet and Teller (BET) method, using an AREA-meter made by Ströhlein & Co., and operated according to the suppliers' instruction manual. The procedure for degassing the samples under investigation is usually left to the operator, but we have found that a degassing procedure in which the samples are heated for 2 hours at 175° C under a stream of dry nitrogen is effective to give repeatable results. Somewhat higher results may sometimes be achieved by degassing at lower temperatures under vacuum but this procedure is more time consuming and less convenient.

It should be mentioned that the calcium carbonate may be adsorbed on a substrate when it is formed, in which case it may not be possible to measure accurately the surface area of the calcium carbonate alone. The effective surface area can then be defined by checking the effectiveness of the calcium carbonate and relating this to the effectiveness of calcium carbonates of known surface areas. Alternatively, it may be possible to use electron microscopy to determine the average particle size, from which an indication of surface area might be obtained, but this should still be checked by determining the effectiveness of the calcium carbonate in use.

As an indication of the general relationship between particle size and surface area, we have found that calcite with a surface area of about 50 $m^2/g$ has an average primary crystal size (diameter) of about 250 Angstrom (A), whilst if the primary crystal size is decreased to about 150 A the surface area increases to about 80 $m^2/g$. But in practice some aggregation takes place to form larger particles. It is desirable that the particle size of the calcium carbonate should be fairly uniform, and in particular that there should be no appreciable quantity of large particles, i.e. over about 15 $\mu$, which could easily be trapped in the fabrics being washed or cause abrasive damage to washing machine parts.

Any crystalline form of calcium carbonate may be used or a mixture thereof, but calcite is preferred because aragonite and vaterite appear to be more difficult to prepare with high surface areas, and it appears that calcite is a little less soluble than aragonite or vaterite as most usual wash temperatures. When any aragonite or vaterite are used it is generally in admixture with calcite. Calcium carbonate can be prepared conveniently by precipitation processes, for example by passing carbon dioxide into a suspension of calcium hydroxide, or by reaction between any fairly soluble calcium salt and a soluble carbonate salt, for example calcium sulphate or calcium hydroxide with sodium carbonate, after which the calcium carbonate needs to be filtered from the reaction medium and then dried. Finely divided calcium carbonate may also be prepared by grinding materials such as limestone or chalk but this is not preferred as it is difficult to obtain a high enough surface area. Suitable forms of calcium carbonate, especially calcite, are commercially available. The calcium carbonate is preferably in substantially pure form but this is not essential and the calcium carbonate may contain minor amounts of other cations with or without other anions. The calcium carbonate may also contain some adsorbed water, before the nonionic detergent compound is adsorbed on it, or some water may be adsorbed on it with the nonionic compound. Relatively large levels of water may in fact be tolerated on the calcium carbonate whilst retaining good flow properties.

The amount of a liquid nonionic compound which can be adsorbed on the finely divided calcium carbonate to give a free flowing product is generally up to about 50%, or in some cases up to about 55%, by weight of the resultant product, that is to say the calcium carbonate can adsorb up to about its own weight of the nonionic detergent compound whilst still giving a free flowing powder, but this is dependent on the selection of the nonionic compound and the calcium carbonate. The more finely divided calcium carbonates tend to be more absorbent, whilst calcium carbonates of relatively low surface area can adsorb lower levels of nonionic detergent compounds e.g. up to about 25% or 33% of the mixed nonionic compound-calcium carbonate premix, whilst retaining good flow properties. Clearly, higher levels of nonionic detergent compounds can be used if desired but this tends to defeat the object of the exercise as the resultant product is then a paste of a powder with poor flow properties. With very low levels of less than, say, about 5% of the nonionic detergent compound on the weight of the calcium carbonate there is clearly little benefit achieved as such low levels can be added to detergent compositions without undue difficulty, but nevertheless such low levels could be used if desired for convenience in processing.

Adsorption of the nonionic compound onto the finely divided calcium carbonate can be achieved by simple admixture with sufficient agitation to distribute the nonionic compound entirely on the calcium carbonate particles. However, it is preferred to distribute the nonionic compound on the calcium carbonate from a solution of the former, after which some or all of the solvent may be removed by evaporation. Suitable solvents include water and organic liquids, such as diethyl ether or lower aliphatic alcohols, e.g. ethanol, which can readily be evaporated and recovered for re-use. Where the solvent is an organic liquid, it is of course, preferable to remove the majority of it before the detergent additive is used, but where the solvent is water this is not so important and appreciable levels of water may be left on the calcium carbonate whilst retaining good flow properties. The amount of any such solvent should usually be a minimum level to dissolve or dilute the nonionic compound to facilitate its even distribution over the calcium carbonate. Solvents are of course of particular benefit in the case of pasty or solid nonionic detergent compounds.

If desired, the calcium carbonate can be admixed with other detergent ingredients before the nonionic compound is added to it, or the nonionic compound can be added to other detergent ingredients and then calcium carbonate is added so as to adsorb the nonionic compound, in which case the detergent compositions are formed directly. The calcium carbonate is preferably in fine powder form but it may alternatively be in the form of granules formed of aggregated or bound finely divided calcium carbonate particles; in this event such granules preferably contain at least about 60% by weight of calcium carbonate and have a particle size within the range of about 0.1 mm to about 2.5 mm.

The amount of a premix formed according to the present invention which is used in detergent compositions depends in particular on the amount of the nonionic detergent compound which is desired in the composition and on the amount of nonionic compound adsorbed on the calcium carbonate. It will of course be appreciated that additional nonionic compounds may be included in detergent compositions without being adsorbed onto calcium carbonate in advance, if desired, especially in the case of solid nonionic detergent compounds. It is an advantage of the present invention that it enables detergent compositions to be made with good flow properties which contain higher levels of nonionic detergent compounds than have been usual hitherto.

The total amount of the detergent compound or compounds used in these compositions is generally in the range of about 5% to 40% by weight, preferably from about 10% to about 25% by weight of the compositions. This can be solely one or a mixture of nonionic detergent compounds, or there may be present other anionic, zwitterionic or amphoteric detergent compounds if desired. When mixtures of nonionic and other detergent compounds are used, the levels of nonionic compounds can be down to about 1% in the compositions but at these low levels there is less benefit from using the process of the present invention. It is preferred that such other detergent compounds should form water soluble calcium salts or that any water insoluble calcium salts which may be formed when they are used alone should be solubilised by the nonionic detergent compound or by effective amounts of other solubilising detergent compounds. Many suitable detergent compounds which can, if desired, be used with the nonionic detergent compounds are described in our aforementioned patent application.

As stated earlier, the present invention finds particular utility in the production of detergent compositions as described in our aforementioned patent application in which the total amount of the calcium carbonate used should be at least 5%, preferably at least about 10% up to about 60%, more preferably from about 15% to about 40% by weight of the detergent compositions. Of course, the detergent compositions may contain calcium carbonate which does not have any nonionic detergent compound adsorbed onto it, as well as calcium carbonate which does have some nonionic compound so adsorbed, especially with the higher total levels of calcium carbonate in the compositions.

The benefit of having calcium carbonate present in a detergent composition is particularly apparent when the detergency builder is an alkali metal carbonate, preferably sodium or potassium carbonate or a mixture thereof, for reasons of cost and efficiency. The carbonate salt is preferably fully neutralised but it may be partially neutralised, for example a sesquicarbonate may be used in partial replacement of the normal carbonate salt; the partial salts tend to be less alkaline and may be less efficient. The amount of the alkali metal carbonate in the detergent composition can be varied widely, but the amount should be at least about 10% by weight, preferably from about 20% to 60% by weight, though an amount of up to about 75% could possibly be used if desired in special products. The amount of the alkali metal carbonate is determined on an anhydrous basis, though the salts may be hydrated either before or when incorporated into the detergent composition. It should be mentioned that within the preferred range the higher levels tend to be required under conditions of use at low product concentrations, as is commonly the practice in North America, and the converse applies under conditions of use at higher product concentrations, as tends to occur in Europe. It should be noted that it may also be desirable to limit the carbonate content to a lower level within the range mentioned, so as to decrease the risk of internal damage following any accidental ingestion, for example by children.

In addition to the alkali metal carbonate in the preferred detergent compositions containing a nonionic detergent compound adsorbed onto calcium carbonate according to the present invention, it is possible to include minor amounts of other detergency builders, provided that the total amount of the detergency builders and the calcium carbonate does not exceed about 85% by weight, so as to leave room in the detergent compositions for other essential ingredients. One such detergency building ingredient is an alkali metal silicate, particularly sodium neutral, alkaline, meta- or orthosilicate. A low level of silicate, for example about 5-10% by weight, is usually advantageous in decreasing the corrosion of metal parts in fabric washing machines, and it may give processing benefits. If higher levels of silicate are used up to a practical maximum of about 30%, for example from about 10% to 20% by weight, there can be a more noticeable improvement in detergency, which may permit some decrease in the alkali metal carbonate content. This effect appears to be particularly beneficial when the compositions are used in water with appreciable levels of magnesium hardness. The amount of silicate can also be used to some extent to control the pH of the composition, which is generally within the range of about 9–11, preferably 10–11 for an aqueous solution of the composition at the recommended concentration. It should be noted that a higher pH (i.e. over about pH 10.5) tends to be more efficient as regards detergency, but it may be less desirable for domestic safety. Sodium silicate is commonly supplied to concentrated aqueous solution, but the amounts are calculated on an anhydrous basis.

Other detergency builders which can be present in detergent compositions containing a nonionic compound adsorbed onto calcium carbonate according to the invention, include other so-called precipitant builders which form insoluble calcium salts, such as the sodium salts of long-chain alpha-sulphonated monocarboxylic acids, and alkali metal salts of alkyl and alkenyl succinic and malonic acids, and analogous compounds, some of which can have a desirable fabric softening effect, and sequestrant builders, especially weak sequestrant builders such as sodium citrate. It should be noted, however, that some detergency builders, especially certain strong seqeustrants such as sodium polyacrylate and other polymeric polycarboxylate builders, and certain organic precipitant builders such as sodium α-sulpho tallow fatty acids, can have a marked detrimental effect on calcium carbonate precipitation when sodium carbonate is used as the principal detergency builder. But in the case of the latter organic precipitant builders which are also softening agents, they can still be added in calcium salt form where they do not inhibit calcium carbonate precipitation but retain their softening properties.

Also, it may be noted that some strong sequestrant builders can dissolve calcium carbonate, which can result in decreased detergency building properties or require the use of larger levels of the builder to compensate for this. Sodium tripolyphosphate is a particularly strong calcium carbonate precipitation inhibitor, and it is desirable to exclude its presence from sodium carbonate-built detergent compositions, quite apart from any eutrophication considerations. In practice, due to plant contamination, its presence at low levels of, say, up to about 0.5% by weight may be unavoidable in detergent compositions; and in wash liquors additional phosphate may be introduced from clothes previously washed in phosphate-built detergent products. It is preferred to have a maximum level of about 0.05% P, which is equivalent to about 2% sodium tripolyphosphate, in such sodium carbonate-built compositions.

Detergent compositions of the invention containing a nonionic detergent compound adsorbed onto calcium carbonate can contain any of the conventional detergent additives in the amounts in which such additives are normally employed in fabric washing detergent compositions. Examples of these additives include lather boosters such as alkanolamides, particularly the monoethanolamides derived from palm kernel fatty acids and coconut fatty acids, lather depressants, anti-redeposition agents, such as sodium carboxymethylcellulose, oxygen-releasing bleaching agents such as sodium perborate and sodium percarbonate, per-acid bleach precursors such as tetraacetyl ethylene diamine, chlorine-releasing bleaching agents such as trichloroisocyanuric acid and alkali metal salts of dichloroisocyanuric acid, fabric softening agents, inorganic salts such as sodium sulphate, and, usually present in very minor amounts, fluorescent agents, perfumes, enzymes such as proteases and amylases, germicides and colourants.

The invention is illustrated by the following Examples in which parts and percentages are by weight except where otherwise indicated.

EXAMPLES 1 to 3

Mixtures were prepared containing amounts of a nonionic detergent compound, Tergitol 15-S-9 which is a condensation product of a linear secondary ($C_{11}$–$C_{15}$) alcohol and 9 moles of ethylene oxide (EO), and calcite (Calofort U50 obtained from J. & E. Sturge Limited of Birmingham, England) having a nominal surface area of about 50 $m^2/g$ and a determined (BET) surface area of about 35 $m^2/g$, in diethyl ether. The ether was then evaporated in a stirred rotary evaporator and the resultant products were examined for their appearance and properties, with the following results:

| Example | Amount of Noinoic Compound | Amount of Calcite | % Nonionic in Product | Appearance |
|---|---|---|---|---|
| 1 | 10 g | 10 g | 50% | free flowing white powder |
| 2 | 12.5 g | 10 g | 55% | free flowing white powder |
| 3 | 15 g | 10 g | 60% | thick white paste |

This shows that up to 55% of the nonionic compound based on the weight of the product can be used with good flow properties. In a subsequent experiment the powder of Example 2 was shaken with water and after th calcite was filtered off the water was evaporated from the filtrate. The amount of the recovered nonionic detergent compound was found to be the same as that originally present (within experimental error), showing that the nonionic compound adsorbed onto calcium carbonate in accordance with this invention can be readily liberated for detergent use in water.

EXAMPLE 4

Two detergent solutions were prepared to the following formulation:

| Ingredient | % |
|---|---|
| Nonionic compound (Tergitol 15-S-9) | 0.024 |
| Calcite (Calofort U50) | 0.1 |
| Sodium carbonate | 0.09 |
| Water (12° H Ca) | to 100 |

In one composition the three ingredients were merely added to the water and in the other the amount of nonionic compound was first adsorbed onto an equal amount of calcite to form a premix which was then added to the water with a further amount of calcite and the sodium carbonate. Detergency tests in a Terg-O-Tometer found both compositions to have the same detergencies (within experimental error), showing that the adsorption of the nonionic compound onto the calcium carbonate does not prevent its desorption and subsequent functioning in detergent compositions.

EXAMPLE 5

Three nonionic detergent compounds were dissolved in diethyl ether and the solutions were mixed thoroughly with calcium carbonate of different types. The diethyl ether was then evaporated in a rotary evaporator and the physical properties of the products noted with different levels of the nonionic compounds on the calcium carbonate. At levels of 20% nonionic detergent compounds in the products, all of the products had good free flowing properties. When the level of the nonionic compounds were raised to 50% the results were as follows:

| | Nonionic detergent compound | | |
|---|---|---|---|
| Calcium carbonate | Sec-lin-($C_{11}$–$C_{15}$) alkyl - 9EO | Nonyl phenol - 11EO | sec $C_{12}$–$C_{15}$ alkyl - 7EO |
| Calcite (10 $m^2/g$)[1] | paste | sticky granular solid | free flowing powder |
| Calcite (23 $m^2/g$)[2] | paste | sticky granular solid | sticky granular solid |
| Calcite (35 $m^2/g$)[3] | ← free flowing powder → | | |
| Calcite (70 $m^2/g$)[4] | free flowing powder | sticky powder | free flowing powder |

[1]Calopake PC, obtained from J. & E. Sturge Limited, England.
[2]Calofort U, obtained from J. & E. Sturge Limited, England.
[3]Calofort U50, obtained from J. & E. Sturge Limited, England.
[4]Supplied by Solvay et Cie, France.

These results show the general benefit of having the higher surface area calcite, with a suitable choice of the nonionic compound if high levels of adsorption are desired. When a test was done with very low surface area calcite (0.3 $m^2/g$) at the higher levels of adsorption the products were thin pastes of no practical use. Further tests showed that the level of adsorption of the sec-linear ($C_{11}$–$C_{15}$) alkyl-9E0 on th calcite having surface area of 35 $m^2/g$ could be raised to 52.5%, still with free flowing properties, whilst at 60% the product was a sticky granular solid. Similarly, using the same nonionic compound but with calcite of 10 $m^2/g$, a free flowing powder was achieved at a level of adsorpiton of 33.3%.

EXAMPLE 6

The procedure of Example 5 was repeated except that the nonionic compound was dissolved in water and the aqueous solution was then admixed with the calcite and the water evaporated. Using the calcite of surface area 35 $m^2/g$ and a level of adsorption of 50%, free flowing products were achieved with the ethoxylated alcohol nonionic compounds. Similar results were achieved with the calcite of surface area 10 $m^2/g$ using the sec-linear ($C^{11}$–$C^{15}$) alkyl-9E0 nonionic compound, but with the calcite of surface area 23 $m^2/g$ the product was a thick paste at the 50% level of adsorption. Free flowing powders are achieved with all the calcites at lower levels of adsorption.

EXAMPLE 7

The procedure of Example 5 was repeated using the calcite of surface area 35 $m^2/g$ and the sec-linear ($C^{11}$–$C^{15}$) alkyl-9E0 compound at 50% adsorption level, but the organic solvent used was ethanol The product was a slightly sticky powder. The properties of the product are improved at lower levels of adsorption.

EXAMPLE 8

The procedure of Example 7 was repeated except that the calcite was replaced by aragonite of surface area 7 $m^2/g$ (Sturcal F obtained from J. & E. Sturge Limited) and the level of adsorption was 20%, and free flowing powder was obtained.

EXAMPLE 9

The procedure of Example 5 was repeated except that the calcite powder was replaced by calcite granules formed from 67.1% calcite of surface area 35 $m^2/g$ with 5% water and 27.4% of $C_{12}$–$C^{15}$ alkyl sulphate present as a binding agent having dispersing properties. The nonionic detergent compound sec-linear ($C_{11}$–$C_{15}$) alkyl-9E0 was adsorbed onto the calcite granules at the 20% level, (27% on the calcite) when a free flow granular product was achieved. When the process was repeated at a level of 50% adsorption on the granules (60% on the calcite) the product was a sticky granular solid.

EXAMPLE 10

A nonionic detergent powder was prepared to the following formulation and found to have a very poor flow properties:

| Ingredient | % |
|---|---|
| Nonionic detergent compound | 14 |
| Soap | 2 |
| Sodium alkyl benzene sulphonate | 2 |
| Sodium tripolyphosphate | 46 |
| Sodium sulphate | 12 |
| Sodium silicate | 7 |
| SCMC etc. | 3 |
| Water | 14 |

This composition was placed in a mixing vessel and calcite powder of surface area 35 $m^2/g$ was added in increasing amounts and thoroughly admixed with th composition. With amounts of 2% and 5% of the calcite there was some slight improvement in flow properties, but with 10% calcite added (i.e. 58% nonionic compound on the nonionic/calcite mixture) th flow properties were very much improved to the extent of being commerically acceptable. With increased amounts of the calcite the powder properties were good until at about 50% the flow properties started to deteriorate as the calcite itself had relatively poor flow properties in the test apparatus concerned because of its extremely small particle size.

EXAMPLE 11

Calcite of surface area 35 $m^2/g$ was placed in a mixing vessel and various amounts of a nonionic detergent compound (sec-linear ($C_{11}$–$C_{15}$) alkyl-9E0 were added with mixing. It was found that the nonionic compound was readily adsorbed onto the calcite powders and that they remained free flowing with up to 30% of the nonionic compound in the product. With higher levels of 35 to 50% of the nonionic compound added the product was a sticky powder, which shows the benefit of using a solvent to distribute the nonionic compound on the calcite at higher levels.

What is claimed is:

1. A solid detergent additive consisting essentially of from about 5% to about 55% by weight of a nonionic detergent compound absorbed onto finely divided calcium carbonate having a surface area of at least about 5 $m^2/g$.

2. A detergent additive according to claim 1 wherein the calcium carbonate is calcite.

3. A detergent additive according to claim 1 wherein the calcium carbonate has a surface area of from about 20 $m^2/g$ to about 100 $m^2/g$.

4. A detergent additive according to claim 1 wherein the calcium carbonate has a surface area of from about 30 $m^2/g$ to about 85 $m^2/g$.

5. A detergent additive according to claim 1, wherein the calcium carbonate is in the form of granules containing at least 60% by weight of finedly divided calcium carbonate particles.

6. A detergent composition consisting essentially of from about 10% to about 75% by weight of an alkali metal carbonate detergency builder and a detergent additive according to claim 1, the amount of nonionic detergent compound in the detergent additives being from about 1% to about 40% by weight of the detergent composition.

7. A detergent additive according to claim 1, wherein the nonionic detergent compound is an ethoxylated synthetic or natural fatty alcohol.

8. A detergent additive according to claim 7 wherein the nonionic detergent compound has $C_{10}$ to $C_{18}$ alkyl groups and about 5 to 12 ethylene oxide groups per molecule.

9. A process for forming a detergent additive according to claim 1 comprising dissolving a nonionic detergent compound in a volatile solvent of water, diethyl ether or lower aliphatic alcohols, mixing the solution with finely divided calcium carbonate having a surface area of at least 5 $m^2/g$, and then evaporating the solvent from the mixture.

10. A process according to claim 9 wherein the solvent is water.

11. A process according to claim 9 wherein the solvent is diethylether.

12. A process according to claim 9 wherein the solvent is ethanol.

* * * * *